US009341972B2

(12) United States Patent
Miyamoto

(10) Patent No.: US 9,341,972 B2
(45) Date of Patent: May 17, 2016

(54) METHOD FOR PRODUCING TONER

(71) Applicant: KYOCERA Document Solutions Inc., Osaka (JP)

(72) Inventor: Hidetoshi Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/336,179

(22) Filed: Jul. 21, 2014

(65) Prior Publication Data

US 2015/0030979 A1 Jan. 29, 2015

(30) Foreign Application Priority Data

Jul. 24, 2013 (JP) ..... 2013-153563

(51) Int. Cl.
*G03G 9/093* (2006.01)

(52) U.S. Cl.
CPC ..... *G03G 9/09307* (2013.01); *G03G 9/0935* (2013.01); *G03G 9/09328* (2013.01); *G03G 9/09392* (2013.01)

(58) Field of Classification Search
CPC ..... G03G 9/09307; G03G 9/09328; G03G 9/09392; G03G 9/0935; G03G 9/09364; G03G 9/09371
USPC ..... 430/110.2, 137.11
See application file for complete search history.

(56) References Cited

U.S. PATENT DOCUMENTS

2005/0271964 A1 12/2005 Etou et al.
2015/0004540 A1* 1/2015 Ozawa ..... G03G 9/08728 430/109.3

FOREIGN PATENT DOCUMENTS

| | | | |
|---|---|---|---|
| JP | S62-262056 | A | 11/1987 |
| JP | 2004-294468 | A | 10/2004 |
| JP | 2004-294469 | A | 10/2004 |
| JP | 2012-189698 | A | 10/2012 |
| JP | 2013-076797 | A | 4/2013 |

OTHER PUBLICATIONS

An Office Action; "Notice of Reasons for Rejection," issued by the Japanese Patent Office on Jun. 30, 2015, which corresponds to Japanese Patent Application No. 2013-153563 and is related to U.S. Appl. No. 14/336,179.

* cited by examiner

*Primary Examiner* — Janis L Dote
(74) *Attorney, Agent, or Firm* — Studebaker & Brackett PC

(57) ABSTRACT

A method for producing a toner, includes the steps of: preparing a core having a zeta potential at pH 4 of −5 mV or less; and forming a cationic shell layer on a surface of the core in a solution in which a material of the shell layer having miscibility with a solvent of 250% by mass or more and 1000% by mass or less is dissolved in the solvent.

8 Claims, 5 Drawing Sheets

| Melamine formaldehyde initial condensate | Miscibility [mass%] | Viscosity [mPa·s] | Reaction conditions | | | |
|---|---|---|---|---|---|---|
| | | | Acid catalyst | pH | Temperature | Time |
| A | 150 | 4700 | Sulfuric acid | 2 | 30 | 3 |
| B | 250 | 1700 | Sulfuric acid | 2 | 35 | 3 |
| C | 600 | 1500 | Sulfuric acid | 2 | 40 | 3 |
| D | 800 | 1000 | Sulfuric acid | 2 | 45 | 3 |
| E | 1000 | 800 | Sulfuric acid | 2 | 50 | 3 |
| F | 1250 | 500 | Sulfuric acid | 2 | 50 | 5 |

FIG. 3

| | Shell layer | Core | | | | Toner particle | | | | | | |
|---|---|---|---|---|---|---|---|---|---|---|---|---|
| | Miscibility [mass%] | Shape index | Chargeability [μC/g] | Zeta potential [mV] | Particle size $D_{50}$ [μm] | Shell film thickness [nm] | Shape index | Chargeability [μC/g] | Zeta potential [mV] | Particle size $D_{50}$ [μm] | High-temperature preservability [mass%] | Lowest fixing temperature [°C] |
| Sample1 | 250 | 0.93 | −20 | −15.0 | 6.5 | 6 | 0.97 | 47 | 45.0 | 6.7 | 8 | 140 |
| Sample2 | 600 | 0.93 | −20 | −15.0 | 6.5 | 6 | 0.97 | 50 | 48.0 | 6.7 | 7 | 145 |
| Sample3 | 800 | 0.93 | −20 | −15.0 | 6.5 | 6 | 0.97 | 50 | 50.0 | 6.7 | 6 | 145 |
| Sample4 | 1000 | 0.93 | −20 | −15.0 | 6.5 | 6 | 0.97 | 55 | 52.0 | 6.7 | 3 | 140 |
| Sample5 | 600 | 0.93 | −20 | −5.2 | 6.5 | 6 | 0.97 | 50 | 13.0 | 6.7 | 8 | 140 |
| Sample6 | 600 | 0.93 | −20 | −10.1 | 6.5 | 6 | 0.97 | 50 | 22.0 | 6.7 | 9 | 142 |
| Sample7 | 250 | 0.93 | −20 | −5.2 | 6.5 | 6 | 0.97 | 50 | 15.0 | 6.8 | 9 | 145 |
| Sample8 | 800 | 0.93 | −20 | −5.2 | 6.5 | 6 | 0.97 | 50 | 15.0 | 6.7 | 8 | 140 |
| Sample9 | 1000 | 0.93 | −20 | −5.2 | 6.5 | 6 | 0.97 | 50 | 14.0 | 6.7 | 9 | 142 |
| Sample10 | 250 | 0.93 | −20 | −15.0 | 6.5 | 9 | 0.97 | 50 | 50.0 | 6.7 | 6 | 145 |
| Sample11 | 600 | 0.93 | −20 | −15.0 | 6.5 | 9 | 0.97 | 55 | 55.0 | 6.7 | 5 | 150 |
| Sample12 | 800 | 0.93 | −20 | −15.0 | 6.5 | 9 | 0.97 | 55 | 55.0 | 6.7 | 3 | 150 |
| Sample13 | 1000 | 0.93 | −20 | −15.0 | 6.5 | 9 | 0.97 | 60 | 55.0 | 6.7 | 2 | 145 |
| Sample14 | 600 | 0.93 | −20 | −5.2 | 6.5 | 9 | 0.97 | 50 | 20.0 | 6.7 | 7 | 145 |
| Sample15 | 600 | 0.93 | −20 | −10.1 | 6.5 | 9 | 0.97 | 50 | 25.0 | 6.7 | 8 | 147 |
| Sample16 | 250 | 0.93 | −20 | −5.2 | 6.5 | 9 | 0.97 | 50 | 27.0 | 6.8 | 7 | 145 |
| Sample17 | 800 | 0.93 | −20 | −5.2 | 6.5 | 9 | 0.97 | 50 | 21.0 | 6.7 | 8 | 145 |
| Sample18 | 1000 | 0.93 | −20 | −5.2 | 6.5 | 9 | 0.97 | 50 | 20.5 | 6.7 | 8 | 147 |
| Sample19 | 250 | 0.93 | −20 | −15.0 | 6.5 | 12 | 0.97 | 50 | 55.0 | 6.7 | 5 | 155 |
| Sample20 | 600 | 0.93 | −20 | −15.0 | 6.5 | 12 | 0.97 | 55 | 55.0 | 6.7 | 4 | 160 |
| Sample21 | 800 | 0.93 | −20 | −15.0 | 6.5 | 12 | 0.97 | 55 | 55.0 | 6.7 | 2 | 160 |
| Sample22 | 1000 | 0.93 | −20 | −15.0 | 6.5 | 12 | 0.97 | 60 | 58.0 | 6.7 | 1 | 155 |
| Sample23 | 600 | 0.93 | −20 | −5.2 | 6.5 | 12 | 0.97 | 50 | 26.0 | 6.7 | 7 | 150 |
| Sample24 | 600 | 0.93 | −20 | −10.1 | 6.5 | 12 | 0.97 | 50 | 30.0 | 6.7 | 8 | 150 |
| Sample25 | 250 | 0.93 | −20 | −5.2 | 6.5 | 12 | 0.97 | 50 | 26.5 | 6.8 | 7 | 155 |
| Sample26 | 800 | 0.93 | −20 | −5.2 | 6.5 | 12 | 0.97 | 50 | 26.0 | 6.7 | 8 | 150 |
| Sample27 | 1000 | 0.93 | −20 | −5.2 | 6.5 | 12 | 0.97 | 50 | 25.8 | 6.7 | 8 | 152 |
| Sample28 | 150 | 0.93 | −20 | −15.0 | 6.5 | 6 | 0.97 | 43 | 8.0 | 9.5 | 40 | 135 |
| Sample29 | 1250 | 0.93 | −20 | −15.0 | 6.5 | 6 | 0.97 | 40 | 5.0 | 13.3 | 60 | 130 |
| Sample30 | 600 | 0.93 | −20 | −3.5 | 6.5 | 6 | 0.97 | 50 | 8.0 | 9.5 | 40 | 145 |
| Sample31 | 150 | 0.93 | −20 | −15.0 | 6.5 | 9 | 0.97 | 42 | 9.0 | 8.9 | 35 | 135 |
| Sample32 | 1250 | 0.93 | −20 | −15.0 | 6.5 | 9 | 0.97 | 40 | 8.0 | 12.3 | 50 | 130 |
| Sample33 | 600 | 0.93 | −20 | −3.5 | 6.5 | 9 | 0.97 | 50 | 8.0 | 9.5 | 40 | 145 |
| Sample34 | 150 | 0.93 | −20 | −15.0 | 6.5 | 12 | 0.97 | 43 | 8.0 | 9.1 | 33 | 140 |
| Sample35 | 1250 | 0.93 | −20 | −15.0 | 6.5 | 12 | 0.97 | 40 | 7.0 | 13.1 | 57 | 140 |
| Sample36 | 600 | 0.93 | −20 | −3.5 | 6.5 | 12 | 0.97 | 50 | 8.0 | 9.5 | 40 | 145 |

FIG. 4

METHOD FOR PRODUCING TONER

INCORPORATION BY REFERENCE

The present application claims priority under 35 U.S.C. §119 to Japanese Patent Application No. 2013-153563, filed Jul. 24, 2013. The contents of this application are incorporated herein by reference in their entirety.

BACKGROUND

The present disclosure relates to a method for producing a toner, and more particularly, it relates to a method for producing a capsule toner.

A capsule toner contains a core and a shell layer (a capsule layer) formed on the surface of the core.

As a method for producing a capsule toner, for example, a method in which a shell layer is formed on the surface of a core with the core dispersed in a solid state in an aqueous medium containing a dispersant dissolved therein has been proposed.

SUMMARY

A method for producing a toner according to the present disclosure includes the steps of: preparing a core having a zeta potential at pH 4 of −5 mV or less; and forming a cationic shell layer on a surface of the core in a solution in which a material of the shell layer is dissolved in a solvent. In the step of forming a shell layer, the miscibility of the material of the shell layer with the solvent is 250% by mass or more and 1000% by mass or less.

BRIEF DESCRIPTION OF THE DRAWINGS

FIG. 3 is a table showing properties of and preparation conditions for solutions of melamine formaldehyde initial condensates used for forming shell layers in methods for producing toners according to examples and comparative examples of the present disclosure.

FIG. 4 is a table showing evaluation results of respective samples obtained in the methods for producing toners according to the examples and comparative examples of the present disclosure.

DETAILED DESCRIPTION

An embodiment of the present disclosure will now be described.

Figure 1:
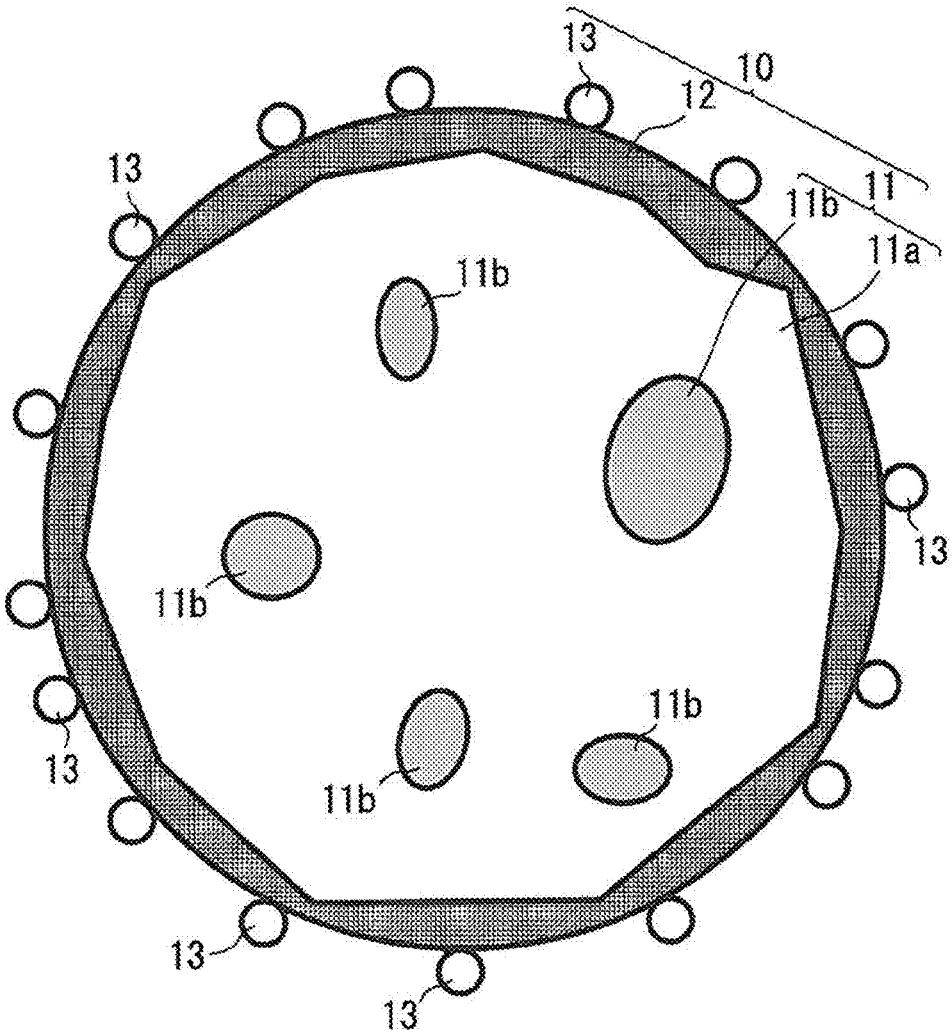
FIG. 1 is a schematic cross-sectional view illustrating a toner particle contained in a toner according to an embodiment of the present disclosure.

A toner according to the present embodiment is an electrostatic latent image developing capsule toner. The toner of the present embodiment is a powder containing a large number of particles (hereinafter referred to as the toner particles). Now, the structure of the toner (each toner particle in particular) of the present embodiment will be described with reference to FIG. 1. FIG. 1 is a schematic cross-sectional view illustrating the structure of a toner particle 10 contained in the toner of the present embodiment.

As illustrated in FIG. 1, the toner particle 10 contains an anionic core 11, a cationic shell layer 12 (capsule layer) formed on the surface of the core 11, and an external additive 13.

The core 11 contains a binder resin 11*a* and an internal additive 11*b* (such as a colorant, a release agent, a charge control agent or a magnetic powder). The core 11 is coated with the shell layer 12. The external additive 13 is attached to the surface of the shell layer 12. Hereinafter, a particle obtained before external addition (namely, a toner particle 10 to which no external additive 13 is attached) is designated as the "toner mother particle".

The structure of the toner particle is, however, not limited to that described above. For example, there is no need to use the internal additive 11*b* or the external additive 13 if not necessary. Alternatively, the toner particle may contain a plurality of shell layers 12 formed on the surface of the core 11. If the toner particle has a plurality of shell layers 12 stacked on one another, the outermost shell layer 12 out of the plurality of shell layers 12 preferably has a cationic property.

Since the core 11 is anionic, a cationic shell material (i.e., a material of the shell layer 12) can be drawn onto the surface of the core 11 in forming the shell layer 12. More specifically, it is presumed that a shell material positively charged in an aqueous medium is electrically drawn to the core 11 negatively charged in the aqueous medium, so as to form the shell layer 12 on the surface of the core 11. Probably because the material of the shell 12 is drawn to the core 11, the shell layer 12 can be easily uniformly formed on the surface of the core 11 even if the core 11 is not highly dispersed in the aqueous medium by using a dispersant.

As an index of the core 11 having an anionic property, a zeta potential of the core 11 measured in an aqueous medium adjusted to pH 4 (hereinafter designated as the zeta potential at pH 4) is negative (namely, less than 0 mV). In order that the core 11 has a good anionic property, the zeta potential at pH 4 of the core 11 is preferably −5 mV or less.

As a method for measuring a zeta potential, for example, an electrophoresis method, an ultrasonic method, or an ESA method is employed.

In the electrophoresis method, an electric field is applied to a particle dispersion for electrophoresing charged particles in the dispersion, so as to calculate a zeta potential on the basis of the electrophoretic mobility thus obtained. An example of the electrophoresis method includes a laser Doppler method (in which electrophoresing particles are irradiated with a laser beam to obtain the electrophoretic mobility on the basis of Doppler shift of scattered light thus obtained). The laser Doppler method has advantages that there is no need to increase the particle concentration in the dispersion, that the number of parameters necessary for calculating a zeta potential is small, and that the electrophoretic mobility can be highly sensitively detected.

In the ultrasonic method, a particle dispersion is irradiated with an ultrasonic wave for vibrating charged particles in the dispersion, so as to calculate a zeta potential on the basis of a potential difference caused by the vibration.

In the ESA method, a high frequency voltage is applied to a particle dispersion for vibrating charged particles in the dispersion so as to cause an ultrasonic wave. Then, a zeta potential is calculated on the basis of the magnitude (strength) of the ultrasonic wave.

The ultrasonic method and the ESA method both have an advantage that a zeta potential can be highly sensitively measured even if a particle dispersion has a high particle concentration (beyond, for example, 20% by mass).

As another index of the core 11 having an anionic property, a frictional charge amount of the core 11 obtained by using a standard carrier (hereinafter designated as the "frictional charge amount of the core") is negative (namely, less than 0 μC/g). In order that the core 11 has a good anionic property, the frictional charge amount of the core 11 is preferably −10 μC/g or less. The frictional charge amount of the core 11 serves as an index for determining how easily the core 11 is charged (or whether the core 11 is easily charged positively or negatively). After causing friction between the core 11 and the standard carrier, the frictional charge amount of the core 11 can be measured by using a QM meter (such as "MODEL 210HS-2A" manufactured by TREK Inc.).

In a method for producing a toner according to the present embodiment, a dispersant (a surfactant) is not used. In general, a dispersant has high wastewater load. If a dispersant is not used, the total organic carbon (TOC) concentration of a wastewater drained in production of a toner can be at a low level (of, for example, 15 mg/L or less) without diluting the wastewater.

From the viewpoint of carbon neutral, the toner preferably contains a biomass-derived material. Specifically, a ratio of biomass-derived carbon in entire carbon contained in the toner is preferably 25% by mass or more and 90% by mass or less. The type of biomass is not especially limited, and the biomass may be a plant biomass or an animal biomass. Among various biomass-derived materials, however, a plant biomass-derived material is more preferably used because such a material is easily inexpensively available in a large amount.

In $CO_2$ present in the air, the concentration of $CO_2$ containing radioactive carbon ($^{14}C$) is retained constant in the air. On the other hand, plants incorporate $CO_2$ containing $^{14}C$ from the air during photosynthesis. Therefore, the concentration of $^{14}C$ in carbon contained in an organic component of a plant is occasionally equivalent to the concentration of $CO_2$ containing $^{14}C$ in the air. The concentration of $^{14}C$ in carbon contained in an organic component of a general plant is approximately 107.5 pMC (percent Modem Carbon). Besides, carbon contained in animals is derived from carbon contained in plants. Therefore, the concentration of $^{14}C$ in carbon contained in an organic component of an animal also shows a similar tendency to that in a plant.

The ratio of biomass-derived carbon in entire carbon contained in a toner can be obtained, for example, in accordance with the following Formula 1:

$$\text{Ratio of biomass-derived carbon (mass \%)} = (X/107.5) \times 100 \qquad \text{Formula 1:}$$

In formula 1, X (pMC) represents a concentration of $^{14}C$ contained in the toner. The concentration of $^{14}C$ in a carbon element of a petrochemical can be measured in accordance with, for example, ASTM-D6866. On the basis of Formula 1 and ASTM-D6866, the ratio of biomass-derived carbon in the entire carbon and the concentration of $^{14}C$ in the toner can be obtained.

From the viewpoint of the carbon neutral, a plastic product containing biomass-derived carbon in a ratio of 25% by mass or more in entire carbon contained therein is preferred. Such a plastic product is given a BiomassPla mark (certified by Japan BioPlastics Association). In the case where the ratio of the biomass-derived carbon in entire carbon contained in the toner is 25% by mass or more, the concentration X of $^{14}C$ in the toner obtained by Formula 1 is 26.9 pMC or more.

Now, the core 11 (including the binder resin 11*a* and the internal additive 11*b*), the shell layer 12 (including a resin and a charge control agent), and the external additive 13 will be successively described.

[Core]

The core 11 constituting the toner particle 10 contains the binder resin 11*a*. Besides, the core 11 may contain the internal additive 11*b* (such as a colorant, a release agent, a charge control agent, and a magnetic powder). Incidentally, it is not indispensable for the core 11 to contain all of these components but a component not necessary depending on the use of the toner (such as a colorant, a release agent, a charge control agent, or a magnetic powder) may be omitted.

[Binder Resin (Core)]

In the core 11, the binder resin 11*a* occupies most (for example, 85% by mass or more) of the core component in many cases. Therefore, it is regarded that the polarity of the binder resin 11*a* largely affects the polarity of the core 11 as a whole. If the binder resin 11*a* has, for example, an ester group, a hydroxyl group, an ether group, an acid group, or a methyl group, the core 11 is liable to be anionic, and if the binder resin 11*a* has an amino group, an amine or an amide group, the core 11 is liable to be cationic.

In order that the core is strongly anionic, the hydroxy value (OHV value) and the acid value (AV value) of the binder resin 11*a* are both preferably 10 mgKOH/g or more.

The solubility parameter (SP value) of the binder resin 11*a* is preferably 10 or more, and more preferably 15 or more. If the SP value is 10 or more, the wettability of the binder resin 11*a* to an aqueous medium is improved because its SP value is close to the SP value of water (that is, 23). Therefore, the dispersibility of the binder resin 11*a* in an aqueous medium can be improved even without using a dispersant.

The glass transition point (Tg) of the binder resin 11*a* is preferably equal to or lower than the curing start temperature of a thermosetting resin contained in the shell layer 12. If the binder resin 11*a* has such a Tg, it is presumed that the fixability of the toner is difficult to lower even in a rapid fixing operation. The curing start temperature of many of thermosetting resins (particularly, melamine-based resins) is approximately 55° C. The Tg of the binder resin 11*a* is preferably 20° C. or more, more preferably 30° C. or more and 55° C. or less, and further more preferably 30° C. or more and 50° C. or less. If the Tg of the binder resin 11*a* is 20° C. or more, the core 11 is difficult to aggregate in forming the shell layer 12.

The glass transition point (Tg) of the binder resin 11*a* can be measured by the following method. The glass transition point (Tg) of the binder resin 11*a* can be obtained on the basis of a heat absorption curve (more specifically, a point of change in specific heat of the binder resin 11*a*) obtained by using a differential scanning calorimeter (DSC) (such as "DSC-6200" manufactured by Seiko Instruments Inc.). For example, with 10 mg of the binder resin 11*a* (measurement sample) put in an aluminum pan, and with an empty aluminum pan used as a reference, a heat absorption curve of the binder resin 11*a* can be obtained through measurement performed under conditions of a measurement temperature range from 25° C. to 200° C. and a temperature increasing rate of 10° C./min. The glass transition point (Tg) of the binder resin can be obtained based on the thus obtained heat absorption curve of the binder resin 11*a*.

The softening point (Tm) of the binder resin 11*a* is preferably 100° C. or less, and more preferably 95° C. or less. If the Tm of the binder resin 11*a* is 100° C. or less, the fixability of the toner is difficult to lower even in a rapid fixing operation.

Besides, a plurality of resins having different softening points Tm may be used in combination for adjusting the Tm of the binder resin 11*a*.

Figure 2:
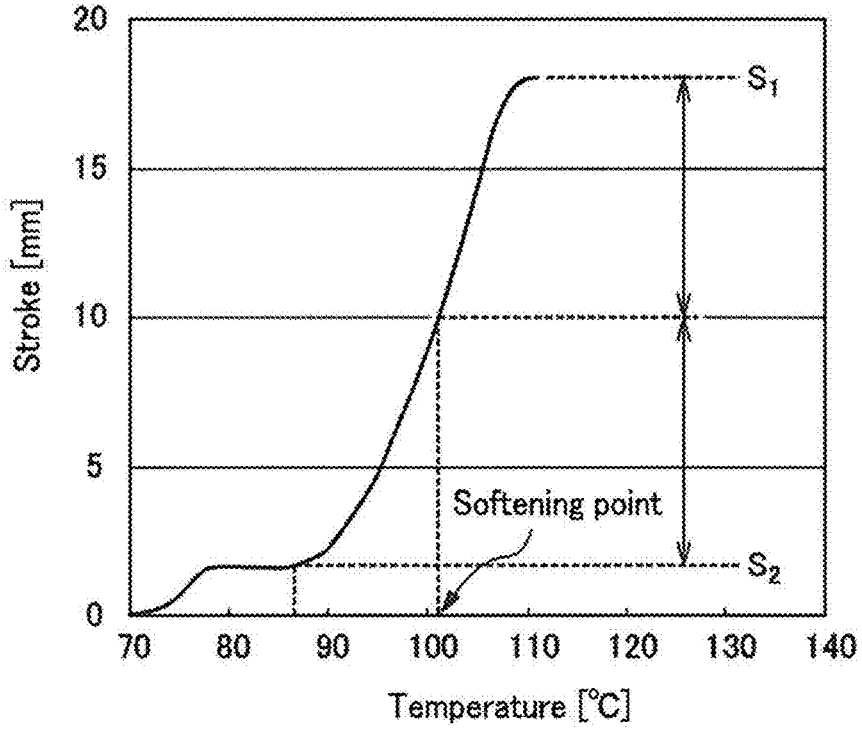
FIG. 2 is a diagram explaining a method for reading a softening point from an S-shaped curve.

The softening point (Tm) of the binder resin 11*a* can be measured by the following method. The softening point (Tm) of the binder resin 11*a* can be measured by using an elevated flow tester (such as "CFT-500D" manufactured by Shimadzu Corporation). For example, with the binder resin 11*a* (measurement sample) set on the elevated flow tester, 1 $cm^3$ of the sample is melt flown under conditions of a die diameter of 1 mm, a plunger load of 20 $kg/cm^2$, and a temperature increasing rate of 6° C./min, and thus, an S shaped curve pertaining to the temperature (° C.)/stroke (mm) can be obtained. Then, the Tm of the binder resin 11*a* can be read from the thus obtained S shaped curve. FIG. 2 is a graph illustrating an example of the S shaped curve. In FIG. 2, S1 represents the maximum value of the stroke and S2 represents a stroke value corresponding to a low-temperature-side base line. On the S shaped curve, a temperature corresponding to a stroke value of (S1+S2)/2 corresponds to the Tm of the measurement sample.

The binder resin 11*a* of FIG. 1 will be continuously described. As the binder resin 11*a*, a rein having, in a molecule, a functional group such as an ester group, a hydroxyl group, an ether group, an acid group, a methyl group, or a carboxyl group is preferred, and a resin having, in a molecule, a hydroxyl group and/or a carboxyl group is more preferred. The core 11 (the binder resin 11*a*) having such a functional group is easily reacted with and chemically bonded to the material of the shell layer 12 (such as methylol melamine). When such a chemical bond is formed, the bond between the core 11 and the shell layer 12 becomes strong.

As the binder resin 11*a*, a thermoplastic resin is preferably used. Suitable examples of the thermoplastic resin used as the binder resin 11*a* include styrene-based resins, acrylic resins, styrene acrylic-based resins, polyethylene-based resins, polypropylene-based resins, vinyl chloride-based resins, polyester resins, polyamide-based resins, polyurethane-based resins, polyvinyl alcohol-based resins, vinyl ether-based resins, N-vinyl-based resins, and styrene-butadiene-based resins. Among these resins, styrene acrylic-based resins and polyester resins are excellent in the dispersibility of a colorant in the toner, the chargeability of the toner, and the fixability of the toner onto a recording medium.

(Styrene Acrylic-Based Resins)

A styrene acrylic-based resin is a copolymer of a styrene-based monomer and an acrylic-based monomer.

Suitable examples of the styrene-based monomer used in preparing the styrene acrylic-based resin (the binder resin 11*a*) include styrene, α-methylstyrene, p-hydroxystyrene, m-hydroxystyrene, vinyl toluene, α-chlorostyrene, o-chlorostyrene, m-chlorostyrene, p-chlorostyrene, and p-ethylstyrene.

Suitable examples of the acrylic-based monomer used in preparing the styrene acrylic-based resin (the binder resin 11*a*) include (meth)acrylic acid, (meth)acrylic acid alkyl ester, and (meth)acrylic acid hydroxyalkyl ester. Suitable examples of the (meth)acrylic acid alkyl ester include methyl (meth)acrylate, ethyl (meth)acrylate, n-propyl(meth)acrylate, iso-propyl(meth)acrylate, n-butyl (meth)acrylate, iso-butyl (meth)acrylate, and 2-ethylhexyl(meth)acrylate. Suitable examples of the (meth)acrylic acid hydroxyalkyl ester include 2-hydroxyethyl(meth)acrylate, 3-hydroxypropyl (meth)acrylate, 2-hydroxypropyl(meth)acrylate, and 4-hydroxypropyl(meth)acrylate.

In preparation of the styrene acrylic-based resin, a hydroxy group can be introduced into the styrene acrylic-based resin by using a monomer having a hydroxyl group (such as p-hydroxystyrene, m-hydroxystyrene, or hydroxyalkyl(meth) acrylate). By appropriately adjusting the amount of the monomer having a hydroxyl group to be used, the hydroxyl value of the resultant styrene acrylic-based resin can be adjusted.

In preparation of the styrene acrylic-based resin, a carboxyl group can be introduced into the styrene acrylic-based resin by using (meth)acrylic acid (a monomer). By appropriately adjusting the amount of the (meth)acrylic acid to be used, the acid value of the resultant styrene acrylic-based resin can be adjusted.

From the viewpoint of the carbon neutral, the binder resin 11*a* is preferably a resin synthesized from biomass-derived acrylic acid or acrylate. An example of a method for preparing the biomass-derived acrylic acid include a method in which biomass-derived glycerin (production method for which will be described later) is dehydrated to give acrolein and the resultant acrolein is oxidized. Alternatively, the biomass-derived acrylate can be prepared by esterifying the biomass-derived acrylic acid by a known method. As an alcohol used in preparing the acrylate, methanol or ethanol prepared from a biomass by a known method is preferably used.

If the binder resin 11*a* is a styrene acrylic-based resin, the number average molecular weight (Mn) of the styrene acrylic-based resin is preferably 2000 or more and 3000 or less for improving the strength of the core 11 or the fixability of the toner. A molecular weight distribution (i.e., a ratio Mw/Mn between the number average molecular weight (Mn) and the mass average molecular weight (Mw)) of the styrene acrylic-based resin is preferably 10 or more and 20 or less. For measuring the Mn and the Mw of the styrene acrylic-based resin, gel permeation chromatography can be employed.

(Polyester Resin)

A polyester resin used as the binder resin 11*a* is obtained by condensation polymerization or co-condensation polymerization of, for example, a bivalent, trivalent, or higher valent alcohol and a bivalent, trivalent, or higher valent carboxylic acid.

If the binder resin 11*a* is a polyester resin, suitable examples of an alcohol used for preparing the polyester resin include diols, bisphenols, and trivalent or higher valent alcohols.

Specific examples of the diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Specific examples of the bisphenols include bisphenol A, hydrogenated bisphenol A, polyoxyethylene-modified bisphenol A, and polyoxypropylene-modified bisphenol A.

Specific examples of the trivalent or higher valent alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methyl propanetriol, 2-methyl-1,2,4-butanetriol, trimethylolethane, trimethylolpropane, and 1,3,5-trihydroxymethylbenzene.

If the binder resin 11*a* is a polyester resin, suitable examples of a carboxylic acid used in preparing the polyester resin include bivalent carboxylic acids and trivalent or higher valent carboxylic acids.

Specific examples of the bivalent carboxylic acids include maleic acid, fumaric acid, citraconic acid, itaconic acid, glutaconic acid, phthalic acid, isophthalic acid, terephthalic acid, cyclohexane dicarboxylic acid, adipic acid, sebacic acid, azelaic acid, malonic acid, succinic acid, and alkyl succinic acid or alkenyl succinic acid (n-butyl succinic acid, n-butenyl succinic acid, isobutyl succinic acid, isobutenyl succinic acid, n-octyl succinic acid, n-octenyl succinic acid, n-dodecyl succinic acid, n-dodecenyl succinic acid, isododecyl succinic acid, or isododecenyl succinic acid).

Specific examples of the trivalent or higher valent carboxylic acids include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene carboxy propane, 1,2,4-cyclohexanetricarboxylic acid, tetra(methylenecarboxyl) methane, 1,2,7,8-octanetetracarboxylic acid, pyromellitic acid, and Empol trimer acid.

Furthermore, any of the aforementioned bivalent, trivalent, or higher valent carboxylic acids may be used in the form of an ester-forming derivative (such as an acid halide, an acid anhydride, or a lower alkyl ester). Here, a "lower alkyl" means an alkyl group having 1 to 6 carbon atoms.

The acid value and the hydroxyl value of the polyester resin can be adjusted by appropriately changing the amount of a bivalent, trivalent or higher valent alcohol and the amount of a bivalent, trivalent or higher valent carboxylic acid to be used in producing the polyester resin. Besides, the acid value and the hydroxyl value of the polyester resin tend to be lowered by increasing the molecular weight of the polyester resin.

From the viewpoint of the carbon neutral, the binder resin 11*a* is preferably a polyester resin synthesized from a biomass-derived alcohol (such as 1,2-propanediol, 1,3-propanediol, or glycerin). An example of the method for preparing glycerin from a biomass includes a method in which a vegetable oil or animal oil is hydrolyzed by a chemical method using an acid or a base, or by a biological method using an enzyme or microorganism. Alternatively, glycerin may be produced from a substrate containing saccharides such as glucose by a fermentation method. The alcohol such as 1,2-propanediol or 1,3-propanediol can be produced by using, as a raw material, the glycerin obtained as described above. The glycerin can be chemically transformed into a target substance by a known method. From the viewpoint of the carbon neutral, the ratio of the biomass-derived carbon in the polyester resin (the binder resin 11*a*) is preferably adjusted so that the concentration of the radioactive carbon isotope $^{14}C$ in entire carbon contained in the toner can be 26.9 pMC or more.

If the binder resin 11*a* is a polyester resin, the number average molecular weight (Mn) of the polyester resin is preferably 1000 or more and 2000 or less for improving the strength of the core 11 or the fixability of the toner. A molecular weight distribution (i.e., a ratio Mw/Mn between the number average molecular weight (Mn) and the mass average molecular weight (Mw)) of the polyester resin is preferably 9 or more and 21 or less. For measuring the Mn and the Mw of the polyester resin, the gel permeation chromatography can be employed.

[Colorant (Core)]

The core 11 may contain a colorant if necessary. As the colorant, any of known pigments or dyes can be used in accordance with the color of the toner. The amount of the colorant to be used is preferably 1 part by mass or more and 20 parts by mass or less, and more preferably 3 parts by mass or more and 10 parts by mass or less based on 100 parts by mass of the binder resin 11*a*.

(Black Colorant)

The core 11 may contain a black colorant. An example of the black colorant includes carbon black. Alternatively, the black colorant may be a colorant whose color is adjusted to black by using a yellow colorant, a magenta colorant, and a cyan colorant.

(Colorant)

The core 11 may contain a colorant such as a yellow colorant, a magenta colorant, or a cyan colorant.

Examples of the yellow colorant include condensed azo compounds, isoindolinone compounds, anthraquinone compounds, azo metal complexes, methine compounds and allylamide compounds. Suitable examples of the yellow colorant include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Bat Yellow.

Examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. A suitable example of the magenta colorant includes C.I. Pigment Red (2, 3, 5, 6, 7, 19, 23, 48:2, 48:3, 48:4, 57:1 81:1, 122, 144, 146, 150, 166, 169, 177, 184, 185, 202, 206, 220, 221, or 254).

Examples of the cyan colorant include copper phthalocyanine compounds, copper phthalocyanine derivatives, anthraquinone compounds, and basic dye lake compounds. Suitable examples of the cyan colorant include C.I. Pigment Blue (1, 7, 15, 15:1, 15:2, 15:3, 15:4, 60, 62, or 66), phthalocyanine blue, C.I. Bat Blue, and C.I. Acid Blue.

[Release Agent (Core)]

The core 11 may contain a release agent if necessary. The release agent is used for purpose of improving the fixability or the offset resistance of the toner. In order to improve the fixability or the offset resistance of the toner, the amount of the release agent to be used is preferably 1 part by mass or more and 30 parts by mass or less, and more preferably 5 parts by mass or more and 20 parts by mass or less based on 100 parts by mass of the binder resin 11*a*.

Examples of the release agent include aliphatic hydrocarbon-based waxes such as low molecular weight polyethylene, low molecular weight polypropylene, polyolefin copolymers, polyolefin wax, microcrystalline wax, paraffin wax, and Fischer-Tropsch wax; oxides of the aliphatic hydrocarbon-based waxes such as polyethylene oxide wax, and a block copolymer of polyethylene oxide wax; vegetable waxes such as candelilla wax, carnauba wax, haze wax, jojoba wax, and rice wax; animal waxes such as beeswax, lanolin, and spermaceti wax; mineral waxes such as ozokerite, ceresin, and petrolatum; waxes containing a fatty acid ester as a principal component, such as montanic acid ester wax, and castor wax; and waxes obtained by deoxidizing part or whole of fatty acid ester, such as deoxidized carnauba wax.

[Charge Control Agent (Core)]

The core 11 may contain a charge control agent if necessary. A charge control agent is used for purpose of improving the charge level or the charge rising property of a toner so as to obtain a toner excellent in the durability or the stability. The charge rising property of a toner is an index whether or not the toner can be charged to prescribed charge level in a short period of time.

When the core 11 contains a negatively chargeable charge control agent, the anionic property (negative chargeability) of the core 11 can be enhanced. In order to improve the charge stability, the charge rising property, the durability or the stability of the toner, or in order to lower the cost for producing the toner, the amount of the negatively chargeable charge control agent to be used is preferably 0.5 part by mass or more and 20.0 parts by mass or less, and more preferably 1.0 part by mass or more and 15.0 parts by mass or less based on 100 parts by mass of the binder resin 11*a*.

Examples of the negatively chargeable charge control agent include organic metal complexes and chelate compounds. As the organic metal complexes and the chelate compounds used as the negatively chargeable charge control agent, acetylacetone metal complexes (such as aluminum acetyl acetonate and iron (II) acetyl acetonate), salicylic acid-based metal complexes and salicylic acid-based metal salts (such as chromium 3,5-di-tert-butylsalicylate) are preferred, and a salicylic acid-based metal complex or a salicylic acid-based metal salt is more preferred. One of these charge control agents may be singly used, or two or more of these charge control agents may be used in combination.

[Magnetic Powder (Core)]

The core 11 may contain a magnetic powder if necessary. If the toner is used as a one-component developer, in order to improve the magnetic property or the fixability of the toner, the amount of the magnetic powder to be used is preferably 35 parts by mass or more and 60 parts by mass or less, and more preferably 40 parts by mass or more and 60 parts by mass or less based on 100 parts by mass of (the total amount of) the toner. Alternatively, if the toner is used as a two-component developer, in order to improve the magnetic property or the fixability of the toner, the amount of the magnetic powder to be used is preferably 20 parts by mass or less, and more preferably 15 parts by mass or less based on 100 parts by mass of (the total amount of) the toner.

Suitable examples of a material of the magnetic powder include iron (such as ferrite or magnetite), ferromagnetic metals (such as cobalt or nickel), alloys containing iron and/or a ferromagnetic metal, compounds containing iron and/or a ferromagnetic metal, ferromagnetic alloys having been ferromagnetized (for example, by heating), and chromium dioxide.

The particle size of the magnetic powder is preferably 0.1 μm or more and 1.0 μm or less, and more preferably 0.1 μm or more and 0.5 μm or less. If the particle size of the magnetic powder is 0.1 μm or more and 1.0 μm or less, the magnetic powder can be easily homogeneously dispersed in the binder resin 11*a*.

[Shell Layer]

The shell layer 12 is preferably constituted mainly from a thermosetting resin. Besides, in order to improve the strength, the hardness, or the cationic property of the shell layer 12, the shell layer 12 more preferably contains a resin having an amino group. If the shell layer 12 contains a nitrogen atom, it can be easily positively chargeable. In order to enhance the cationic property of the shell layer 12, the content of the nitrogen atom in the shell layer 12 is preferably 10% by mass or more.

Preferable examples of the thermosetting resin constituting the shell layer 12 include a melamine resin, a urea resin, a sulfonamide resin, a glyoxal resin, a guanamine resin, an aniline resin, a polyimide resin, and a derivative of any of these resins. The polyimide resin has a nitrogen element in its molecular skeleton. Therefore, the shell layer 12 containing the polyimide resin is liable to be strongly cationic. Suitable examples of the polyimide resin constituting the shell layer 12 include a maleimide-based polymer, and a bismaleimide-based polymer (such as an amino bismaleimide polymer or a bismaleimide triazine polymer).

As the thermosetting resin constituting the shell layer 12, a resin produced by condensation polymerization of a compound having an amino group and aldehyde (such as formaldehyde) (which resin is hereinafter referred to as an amino aldehyde resin) is particularly preferred. It is noted that a melamine resin is a polycondensate of melamine and formaldehyde. A urea resin is a polycondensate of urea and formaldehyde. A glyoxal resin is a polycondensate of a reactant of glyoxal and urea, and formaldehyde.

The thickness of the shell layer 12 is preferably 1 nm or more and 20 nm or less, and more preferably 1 nm or more and 10 nm or less. If the thickness of the shell layer 12 is 20 nm or less, the shell layer 12 can be easily broken by heat and pressure applied in fixing the toner onto a recording medium. As a result, the binder resin 11*a* and the release agent contained in the core 11 are rapidly softened or molten, so that the toner can be fixed on the recording medium at a low temperature. Besides, if the thickness of the shell layer 12 is 20 nm or less, the chargeability of the shell layer 12 cannot be too strong, and hence, image formation can be properly performed. On the other hand, if the thickness of the shell layer 12 is 1 nm or more, the strength of the shell layer 12 is sufficiently large, and hence, the shell layer 12 is difficult to break even when impact is applied to the toner (for example, during transportation). As a result, the preservability of the toner is improved.

The thickness of the shell layer 12 can be measured by analyzing a TEM image of the cross-section of the toner particle 10 by using commercially available image analysis software (such as "WinROOF" manufactured by Mitani Corporation).

The shell layer 12 preferably has a fracture portion (that is, a portion with low mechanical strength). A fracture portion can be formed by locally causing a defect in the shell layer 12. When the shell layer 12 is provided with a fracture portion, the shell layer 12 can be easily broken by applying heat and pressure for fixing the toner onto a recording medium. As a result, even if the shell layer 12 is constituted from a thermosetting resin, the toner can be fixed on a recording medium at a low temperature. The number of fracture portions is arbitrary.

[Charge Control Agent (Shell Layer)]

The shell layer 12 may contain a charge control agent if necessary. A charge control agent is used for purpose of improving the charge level or the charge rising property of a toner so as to obtain a toner excellent in the durability or the stability.

When the shell layer 12 contains a positively chargeable charge control agent, the cationic property (positive chargeability) of the shell layer 12 can be enhanced. In order to improve the charge rising property, the durability, or the stability of the toner, or in order to lower the cost for producing the toner, the amount of the positively chargeable charge control agent to be used is preferably 0.5 part by mass or more and 20.0 parts by mass or less, and more preferably 1.0 part by mass or more and 15.0 parts by mass or less based on 100 parts by mass of the resin constituting the shell layer 12.

Suitable examples of the positively chargeable charge control agent include an azine compound (a direct dye containing an azine compound), a nigrosine compound (an acidic dye containing a nigrosine compound), a metal salt of naphthenic acid or higher fatty acid, alkoxylated amine, alkyl amide, and a quaternary ammonium salt. For improving the charge rising property of the toner, a nigrosine compound is particularly preferably used. Incidentally, one of these charge control agents may be singly used, or two or more of these may be used in combination.

Specific examples of the azine compound include pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline. Specific examples of the direct dye containing an azine compound include azine fast red FC, azine fast red 12BK, azine violet BO, azine brown 3G, azine light brown GR, azine dark green BH/C, azine deep black EW, and azine deep black 3RL. Specific examples of the nigrosine compound include nigrosine, a nigrosine salt, and a nigrosine derivative. Specific examples of the acidic dye containing a nigrosine compound include nigrosine BK, nigrosine NB, and nigrosine Z. Specific examples of the quaternary ammonium salt include benzylmethylhexyldecyl ammonium chloride, decyl trimethyl ammonium chloride, tributyl benzyl ammonium-1-hydroxy-4-naphthalene sulfonate, tributyl benzyl ammonium-2-hydroxy-8-naphthalene sulfonate, triethyl benzyl ammonium-1-hydroxy-4-naphthalene sulfonate, tripropyl benzyl ammonium-1-hydroxy-4-naphthalene sulfonate, tripropyl benzyl ammonium-2-hydroxy-6-naphthalene sulfonate, trihexyl benzyl ammonium-1-hydroxy-4-naphthalene sulfonate, tetrabutyl ammonium-1-hydroxy-4-naphthalene sulfonate, and tetraoctyl ammonium-1-hydroxy-4-naphthalene sulfonate.

Also, a resin containing at least one of a quaternary ammonium salt, a carboxylate, and a carboxyl group (such as a styrene-based resin, an acrylic resin, a styrene-acrylic-based resin, or a polyester resin) can be used as the positively chargeable charge control agent. One of such resins may be singly used, or two or more of these may be used in combination. The molecular weight of the resin is arbitrary.

[External Additive]

The external additive 13 may be attached to the surface of the shell layer 12 if necessary. The external additive 13 is used for improving the flowability or the handling property of the toner. In order to improve the flowability or the handling property of the toner, the amount of the external additive 13 to be used is preferably 0.5 part by mass or more and 10 parts by mass or less, and more preferably 2 parts by mass or more and 5 parts by mass or less based on 100 parts by mass of the toner mother particles.

Suitable examples of the external additive 13 include silica, and a metal oxide (such as alumina, titanium oxide, magnesium oxide, zinc oxide, strontium titanate, or barium titanate). One of these external additives may be singly used, or two or more of these external additives may be used in combination.

In order to improve the flowability or the handling property of the toner, the particle size of the external additive 13 is preferably 0.01 μm or more and 1.0 μm or less.

Next, a case where the toner of the present embodiment is mixed with a carrier to be used as a two-component developer will be described. In order to form an image with a desired image density by using a two-component developer, or in order to suppress scattering of the toner within a developing unit, the content of the toner in the two-component developer is preferably 3% by mass or more and 20% by mass or less, and more preferably 5% by mass or more and 15% by mass or less.

[Carrier for Two-Component Developer]

A suitable example of the carrier for a two-component developer includes a magnetic carrier containing a carrier core, and a resin layer coating the carrier core. For preparing a magnetic carrier, a magnetic material may be used for forming the carrier core, or magnetic particles may be dispersed in the resin layer.

Specific examples of the carrier core include a particle of a material such as iron, oxidized iron, reduced iron, magnetite, copper, silicon steel, ferrite, nickel, or cobalt, or a particle of an alloy of such a material and manganese, zinc, or aluminum; a particle of an iron-nickel alloy or an iron-cobalt alloy; a particle of a ceramic such as titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate; and a particle of a high-dielectric constant material such as ammonium dihydrogen phosphate, potassium dihydrogen phosphate, or Rochelle salt. One type of these particles may be singly used, or two or more types of the particles may be used in combination.

Specific examples of the resin layer coating the carrier core include (meth)acrylic-based polymers, styrene-based polymers, styrene-(meth)acrylic-based copolymers, olefin-based polymers (such as polyethylene, chlorinated polyethylene, and polypropylene), polyvinyl chloride, polyvinyl acetate, polycarbonate, cellulose resins, polyester resins, unsaturated polyester resins, polyamide resins, polyurethane resins, epoxy resins, silicone resins, fluorine resins (such as polytetrafluoroethylene, polychlorotrifluoroethylene, and polyvinylidene fluoride), phenol resins, xylene resins, diallyl phthalate resins, polyacetal resins, and amino resins. One of these resins may be singly used, or two or more of these may be used in combination.

In order to improve the magnetic property or the flowability of the carrier, the particle size of the carrier is preferably 20 μm or more and 120 μm or less, and more preferably 25 μm or more and 80 μm or less. The particle size of the carrier can be measured by observation with an electron microscope.

Next, a method for producing a toner of the present embodiment will be described.

For producing a toner, an anionic core 11 (more specifically, a core 11 having a zeta potential at pH 4 of −5 mV or less) is prepared first. Then, the core 11 is added to a solution of a cationic shell material (i.e., a material of a shell layer 12) dissolved in a solvent, and the shell layer 12 is formed on the surface of the core 11 in the solution. As a result, toner mother particles containing the core 11 and the shell layer 12 can be obtained.

Subsequently, the thus obtained toner mother particles are washed with, for example, water. Then, the toner mother particles are dried by, for example, using a dryer. Thereafter, an external additive 13 is attached to the surface of each toner mother particle. As a result, toner particles 10 each containing the anionic core 11 and the cationic shell layer 12 coating the surface of the core 11 is obtained. By simultaneously producing a large number of toner particles 10 by the aforementioned method, a toner containing a large number of toner particles 10 can be efficiently produced.

Now, the preparation of the core 11, the formation of the shell layer 12, the washing, the drying and the external addition performed in the method for producing a toner of the present embodiment will be successively described.

[Preparation of Core]

The core 11 can be prepared by, for example, a pulverization/classification method (a melt kneading method) or an aggregation method. When such a method is employed, the internal additive 11*b* can be satisfactorily dispersed in the binder resin 11*a*.

(Preparation of Core by Pulverization/Classification Method)

For preparing the core 11 by the pulverization/classification method, the binder resin 11*a* and the internal additive 11*b* are first mixed with each other. Then, the thus obtained mixture is melt kneaded. Subsequently, the thus obtained melt kneaded product is pulverized and classified. As a result, the core 11 having a desired particle size can be obtained. When the pulverization/classification method is employed, the core 11 can be prepared more easily than by the aggregation method.

(Preparation of Core by Aggregation Method)

For preparing the core 11 by the aggregation method, fine particles containing a core component (such as the binder resin 11*a*) are aggregated in an aqueous medium first. More specifically, an aqueous dispersion (hereinafter designated as the resin dispersion) containing fine particles of the binder resin 11*a* (hereinafter designated as the resin particles) is obtained by micronizing the binder resin 11*a* to a desired size in an aqueous medium. Subsequently, the resin particles are aggregated in the resin dispersion. Aggregated particles are formed by aggregating the resin particles.

As a suitable method for aggregating the resin particles, for example, after adjusting the pH of the resin dispersion, an aggregating agent is added to the resin dispersion, and the temperature of the resin dispersion is adjusted so as to aggregate the resin particles. Besides, after the aggregation of the resin particles has proceeded to attain a desired particle size of the aggregated particles, an aggregation terminator may be added to the aqueous medium.

In adding the aggregating agent, the resin dispersion preferably has pH of 8 or higher. Besides, in order to make the aggregation of the resin particles satisfactorily proceed, the temperature of the resin dispersion at which the resin particles are aggregated is preferably equal to or higher than the glass transition point (Tg) of the binder resin 11*a*, and lower than a temperature higher by 10° C. than the glass transition point (Tg) of the binder resin 11*a* (namely, Tg+10° C.).

In order to make the aggregation of the resin particles satisfactorily proceed, the amount of the aggregating agent to be added is preferably 1 part by mass or more and 50 parts by mass or less based on 100 parts by mass of a solid content of the resin dispersion. The amount of the aggregating agent to be added is preferably appropriately adjusted in accordance with the type and amount of dispersant contained in the resin dispersion. The aggregating agent may be added at one time, or gradually added.

Specific examples of the aggregating agent include an inorganic metal salt, an inorganic ammonium salt, and a bivalent or higher valent metal complex. Alternatively, a quaternary ammonium salt type cationic surfactant, or a nitrogen-containing compound (such as polyethyleneimine) can be used as the aggregating agent. Suitable examples of the inorganic metal salt used as the aggregating agent include a metal salt (such as sodium sulfate, sodium chloride, calcium chloride, calcium nitrate, barium chloride, magnesium chloride, zinc chloride, aluminum chloride, or aluminum sulfate), and an inorganic metal salt polymer (such as polyaluminum chloride or polyaluminum hydroxide). Suitable examples of the inorganic aluminum salt used as the aggregating agent include ammonium sulfate, ammonium chloride, and ammonium nitrate. One of these aggregating agents may be singly used, or two or more of these aggregating agents may be used in combination.

If two or more aggregating agents are used together, a bivalent metal salt and a monovalent metal salt are preferably used together. A bivalent metal salt and a monovalent metal salt are different in the speed of aggregating the resin particles. Therefore, when they are used together, a particle size distribution of the aggregated particles can be easily made sharp while suppressing increase of the particle size of the resulting aggregated particles.

Specific examples of the aggregation terminator include sodium chloride, potassium chloride, and magnesium chloride.

The resin dispersion may contain a surfactant. If a surfactant is used, the resin particles can be easily stably dispersed in the aqueous medium. In order to improve the dispersibility of the resin particles, the amount of the surfactant to be used is preferably 0.01 part by mass or more and 10 parts by mass or less based on 100 parts by mass of the resin particles. Suitable examples of the surfactant include an anionic surfactant, a cationic surfactant, and a nonionic surfactant. Among these, an anionic surfactant is particularly preferred.

Suitable examples of the anionic surfactant include a sulfuric acid ester salt type surfactant, a sulfonic acid salt type surfactant, a phosphoric acid ester salt type surfactant, and soap. Suitable examples of the cationic surfactant include an amine salt type surfactant and a quaternary ammonium salt type surfactant. Suitable examples of the nonionic surfactant include a polyethylene glycol type surfactant, an alkylphenol ethylene oxide adduct type surfactant, and a polyvalent alcohol type surfactant (such as one containing a polyvalent alcohol, such as glycerin, sorbitol, or sorbitan, and a fatty acid ester-bonded to each other). One of these surfactants may be singly used, or two or more of these may be used in combination.

After forming the aggregated particles by the aforementioned aggregation process, the obtained aggregated particles are coalesced in an aqueous medium to prepare the core 11. The aggregated particles can be coalesced by, for example, heating the aqueous dispersion containing the aggregated particles. In order to satisfactorily coalesce the aggregated particles, the aqueous dispersion containing the aggregated particles is heated preferably to a temperature that is equal to or higher than a temperature higher by 10° C. than the glass transition point (Tg) of the binder resin 11*a* (namely, Tg+10° C.), and is equal to or lower than the melting point (Mp) of the binder resin 11*a*. An aqueous dispersion containing the core 11 can be obtained by coalescing the aggregated particles.

Subsequently, the aqueous dispersion containing the core 11 is subjected to filtration (solid-liquid separation) to collect the core 11 in the form of a wet cake. The thus obtained wet cake is washed with water. The washing process is, however, not limited to this but may be arbitrarily performed. For example, the core 11 contained in the aqueous dispersion is precipitated, the supernatant is exchanged with water, and the core 11 is dispersed again in water after the exchange.

Thereafter, the washed core 11 is dried by using a dryer (such as a spray dryer, a fluidized-bed dryer, a vacuum freeze dryer, or a vacuum dryer). The drying process is, however, not limited to this but may be arbitrarily performed.

The method for preparing the core 11 described above can be arbitrarily modified in accordance with the structure, a desired characteristic or the like of the core 11. An unnecessary process (such as the washing process or the drying process) can be omitted. Besides, each process is preferably optimized in accordance with the components of the core 11 or the like. Now, an aggregation process performed when the core 11 containing the binder resin 11*a*, a colorant and a release agent (both of which correspond to the internal additive 11*b*) is prepared by the aggregation method will be described.

For preparing the core 11 containing the binder resin 11*a*, a colorant and a release agent, for example, an aqueous dispersion containing fine particles (resin particles) of the binder resin 11*a* (which dispersion is hereinafter designated as the resin dispersion), an aqueous dispersion containing fine particles of the colorant (hereinafter referred to as the coloring particles) (which dispersion is hereinafter designated as the coloring dispersion), and an aqueous dispersion containing fine particles of the release agent (hereinafter referred to as the release particles) (which dispersion is hereinafter designated as the release dispersion) are respectively prepared, and the three dispersions thus prepared are mixed. Subsequently, in the thus obtained mixed dispersion, the resin particles, the coloring particles and the release particles are aggregated, so as to form aggregated particles containing the binder resin 11*a*, the colorant, and the release agent.

(Preparation Method for Resin Dispersion)

For the preparation of the resin dispersion, first, the binder resin 11*a* is primarily pulverized by using a pulverizer such as a turbo mill Subsequently, the resulting primarily pulverized product is dispersed in an aqueous medium such as ion-exchanged water to obtain a dispersion containing the primarily pulverized product. Then, the thus obtained dispersion containing the primarily pulverized product is heated. The heating temperature is preferably equal to or higher than a temperature higher by 10° C. than the softening point (Tm) of the binder resin 11*a* (i.e., Tm+10° C.), and lower than 200° C.

Thereafter, to the heated dispersion of the primarily pulverized product, a strong shearing force is applied by using a high-speed shearing emulsifier (such as "Clearmix" manufactured by M Technique Co., Ltd.). As a result, the resin dispersion is obtained.

The volume average particle size ($D_{50}$) of the resin particles is preferably 1 μm or less, and more preferably 0.05 μm or more and 0.5 μm or less. If the volume average particle size ($D_{50}$) of the resin particles is 1 μm or less, the particle size distribution of the core 11 can be easily made sharp, and the shape of the core 11 can be easily made uniform. The volume average particle size ($D_{50}$) of the resin particles can be measured by using a laser diffraction particle size analyzer (such as "SALD-2200" manufactured by Shimadzu Corporation).

In using a resin having an acidic group as the binder resin 11*a*, if the resin is directly micronized in an aqueous medium, the specific surface area of the resin particle is probably increased. Therefore, the pH of the aqueous medium may be lowered to approximately 3 to 4 due to the influence of the acidic group exposed on the surface of the resin particles. If the pH of the aqueous medium is lowered to approximately 3 to 4, the resin particles may be hydrolyzed, or the resin particles cannot be micronized to a desired particle size.

In order to suppress the aforementioned problem derived from the acidic group, a basic substance may be added to the aqueous medium in preparing the resin particles. Suitable examples of the basic substance include an alkali metal hydroxide (such as sodium hydroxide, potassium hydroxide, or lithium hydroxide), an alkali metal carbonate (such as sodium carbonate or potassium carbonate), an alkali metal hydrogencarbonate (such as sodium hydrogencarbonate or potassium hydrogencarbonate), and a nitrogen-containing organic base (such as N,N-dimethylethanolamine, N,N-diethylethanolamine, triethanolamine, tripropanolamine, tributanolamine, triethylamine, n-propylamine, n-butylamine, isopropylamine, monomethanolamine, morpholine, methoxypropylamine, pyridine, or vinylpyridine).

(Preparation Method for Coloring Dispersion)

The coloring dispersion can be prepared by dispersing, by using a disperser, the coloring particles in an aqueous medium containing a surfactant. For the preparation of the coloring dispersion, any of various surfactants described above as the surfactants usable for the preparation of the resin dispersion can be used. The surfactant used in the preparation of the coloring dispersion and the surfactant used in the preparation of the resin dispersion can be the same as or different from each other. In order to improve the dispersibility of the coloring particles, the amount of the surfactant to be used is preferably 0.01 part by mass or more and 10 parts by mass or less based on 100 parts by mass of the colorant.

Suitable examples of the disperser include a pressure disperser and a medium type disperser. Specific examples of the pressure disperser include an ultrasonic disperser, mechanical homogenizer, Manton Gaulin, a pressure homogenizer, and a "high-pressure homogenizer" manufactured by Yoshida Kikai Co., Ltd. Specific examples of the medium type disperser include a sand grinder, a horizontal bead mill, a vertical bead mill, "Ultra Apex Mill" manufactured by Kotobuki Industries Co., Ltd., "Dyno Mill" manufactured by WAB Company, and "MSC mill" manufactured by Nippon Coke and Engineering Co., Ltd.

The volume average particle size ($D_{50}$) of the coloring particles is preferably 0.01 μm or more and 0.2 μm or less. The volume average particle size ($D_{50}$) of the coloring particles can be measured by using a laser diffraction particle size analyzer (such as "SALD-2200" manufactured by Shimadzu Corporation).

(Preparation Method for Release Dispersion)

For the preparation of the release dispersion, first, the release agent is precedently pulverized into a size of approximately 100 μm or less to obtain a powder of the release agent. Subsequently, the obtained powder of the release agent is added to an aqueous medium containing a surfactant to prepare a slurry. For the preparation of the release dispersion, any of the various surfactants described above as the surfactants usable for the preparation of the resin dispersion can be used. The surfactant used in the preparation of the release dispersion and the surfactant used in the preparation of the resin dispersion can be the same as or different from each other. In order to improve the dispersibility of the release particles, the amount of the surfactant to be used is preferably 0.01 part by mass or more and 10 parts by mass or less based on 100 parts by mass of the release agent.

Subsequently, the obtained slurry is heated to a temperature equal to or higher than the melting point of the release agent. To the heated slurry, a strong shearing force is applied by using a homogenizer (such as "Ultra-Turrax T50" manufactured by IKA) or a pressure-ejecting type disperser. As a result, the release dispersion is prepared.

Suitable examples of the apparatus for applying a shearing force include "NANO3000" manufactured by Beryu Co., Ltd., "Nanomizer" manufactured by Yoshida Kikai Co., Ltd., "Microfluidizer" manufactured by MFI, "Gaulin Homogenizer" manufactured by Manton Gaulin, and "Clearmix W Motion" manufactured by M Technique Co., Ltd.

In order to homogeneously disperse the release agent in the binder resin 11*a*, the volume average particle size ($D_{50}$) of the release particles contained in the release dispersion is preferably 1 μm or less, more preferably 0.1 μm or more and 0.7 μm or less, and further more preferably 0.28 μm or more and 0.55 μm or less. The volume average particle size ($D_{50}$) of the release particles can be measured by using a laser diffraction particle size analyzer (such as "SALD-2200" manufactured by Shimadzu Corporation).

[Formation of Shell Layer]

For the formation of the shell layer 12, the pH of a solvent (such as an aqueous medium) is first adjusted. The pH of the solvent is preferably adjusted to about 4 by using an acidic substance. By adjusting the pH of the dispersion to be on the acidic side (to about 4), condensation polymerization of a material used for forming the shell layer 12 can be accelerated.

Subsequently, a cationic shell material (a material of the shell layer 12) is dissolved in the solvent whose pH has been adjusted, so as to obtain a solution of the shell material.

(Shell Material)

The shell material preferably contains a monomer or a prepolymer of a thermosetting resin. The shell material preferably has an electron-releasing group. Besides, in order to improve the strength or the hardness of the shell layer 12, or improve the cationic property of the shell material, the shell material more preferably contains a monomer or a prepolymer having an amino group. A shell material containing a nitrogen atom is easily positively chargeable. In order to enhance the cationic property, the content of the nitrogen atom in the shell material is preferably 10% by mass or more.

Suitable examples of the shell material include monomers or prepolymers of thermosetting resins (particularly, a melamine resin, a urea resin, a sulfonamide resin, a glyoxal resin, a guanamine resin, an aniline resin, a polyimide resin, and a derivative of each of these resins). In particular, methylol melamine, benzoguanamine, acetoguanamine, spiroguanamine, maleimide, bismaleimide, amino bismaleimide, or bismaleimide triazine is preferably used.

The shell material preferably contains a monomer or a prepolymer of an amino aldehyde resin, and more preferably contains a melamine formaldehyde initial condensate. A melamine formaldehyde initial condensate can be synthesized by methylolating melamine by a reaction with formaldehyde in methanol and methylating the resultant. Various compositions respectively having different composition ratios among a methylol group (—$CH_2OH$), a methoxy group (—$OCH_3$), a methylene group (—$CH_2$—), and an imino group (—NH—) can be produced by changing the amount of formaldehyde to be added to melamine and the amount of methanol to be reacted with a methylol group. As the amount of imino group is smaller, the curing temperature of the resulting melamine formaldehyde initial condensate tends to be higher. It is presumed that the amount of a melamine group corresponds to the degree of condensation. As the amount of melamine group is smaller, a composition containing the melamine formaldehyde initial condensate tends to be concentrated to form a shell layer 12 having a high crosslink density. In order to suppress the production of formaldehyde, the amount of methylol group is preferably smaller. As the amount of methylol group is larger, the stability of the composition containing the melamine formaldehyde initial condensate tends to be lowered, so that formaldehyde can be produced in a larger amount in the production of the toner.

The melamine formaldehyde initial condensate is easily properly adsorbed onto the surface of an anionic solid particle in a solvent (such as an aqueous medium). Therefore, an in-situ polymerization reaction between a functional group (such as a hydroxyl group or a carboxyl group) present on the surface of the core 11 and the shell material (i.e., a reaction for bonding the core 11 and the shell material to each other) can easily proceed. Besides, if the shell material contains the melamine formaldehyde initial condensate, the dispersibility of the core 11 can be easily retained high until the curing reaction of the shell layer 12 is completed.

In the formation of the shell layer 12, the miscibility of the shell material with the solvent is preferably 250% by mass or more and 1000% by mass or less. If the miscibility of the shell material with the solvent is 250% by mass or more and 1000% by mass or less, the affinity of the shell material to the solvent (such as an aqueous medium) can be at a proper level, and hence, the shell material (such as the melamine formaldehyde initial condensate) can be strongly bonded to the surface of the core 11 while retaining the dispersibility of the core 11 high in the formation of the shell layer 12. Incidentally, the miscibility of the shell material with the solvent corresponds to the solubility of the solvent (such as an aqueous medium) in the shell material (such as a solution of the melamine formaldehyde initial condensate). For example, if the miscibility of the shell material with the solvent is 600% by mass, the solvent in an amount six times (in a mass ratio) as much as the shell material can penetrate into the shell material. As the degree of polymerization of the shell material is higher, the miscibility of the shell material with the solvent tends to be lower.

(Synthesis Method for Melamine Formaldehyde Initial Condensate)

For synthesizing a melamine formaldehyde initial condensate, a reaction (methylolation) is caused between melamine and formaldehyde in, for example, a highly alkaline methanol solution of pH 12 or higher. Besides, at least a part of the methanol is distilled off during the methylolation. Subsequently, methanol is added to the thus obtained reaction product to cause a reaction (methylation) therebetween under an acidic condition. Thus, a methanol solution of a melamine formaldehyde initial condensate can be obtained. Thereafter, this solution is preferably concentrated by atmospheric distillation or vacuum distillation as occasion demands.

Now, an example of the methylolation (the reaction between melamine and formaldehyde) and an example of the methylation (the reaction between methylolated melamine and methanol) performed in the synthesis method for a melamine formaldehyde initial condensate will be described.

(Methylolation)

The methylolation is performed in, for example, a methanol solution. Methanol is used in an amount of preferably 1.5 moles or more and 5 moles or less, and more preferably 2 moles or more and 3 moles or less per mole of melamine. If the amount (in mole) of the methanol is not more than five times as much as the amount (in mole) of the melamine, excessive increase of the number of methylol groups in the resulting melamine formaldehyde initial condensate can be suppressed. On the other hand, if the amount (in mole) of the methanol is not less than 1.5 times as much as the amount (in mole) of the melamine, deposition of the produced methylolated melamine during the reaction can be suppressed, and furthermore, degradation of the flowability can be suppressed.

The methylolation is preferably performed at pH 12 or higher. If the pH is lower than 12 during the reaction, there is a possibility that a product (such as methylolated melamine) is deposited during the reaction to degrade the flowability. Besides, if the pH is lower than 12 during the reaction, the number of methylol groups in the resulting melamine formaldehyde initial condensate tends to increase. The upper limit of the pH during the reaction is not especially limited, but the pH of about 12 is practically employed during the reaction. For adjusting the pH, a hydroxide of an alkali metal or an alkali earth metal (such as sodium hydroxide, potassium hydroxide, or calcium hydroxide), or a metal oxide (such as calcium oxide or magnesium oxide) can be used. Besides, two or more compounds can be used together for adjusting the pH. Industrially, sodium hydroxide is preferably used.

For producing formaldehyde, a methanol solution containing formaldehyde or paraformaldehyde in a high concentration is preferably used. The formaldehyde is used in an amount of preferably 3 moles or more and 6 moles or less, and more preferably 3.5 moles or more and 5 moles or less per mole of melamine.

The methylolation is performed preferably at a temperature of 50° C. or higher and a reflux temperature or lower for 0.5 hour or more and 5 hours or less. During or after the methylolation, at least a part of the methanol used as the solvent is preferably distilled off. The methanol to be distilled off can be a part of the solvent or substantially the whole of the solvent. By distilling off the methanol, the concentration of the reaction solution is increased so as to reduce free formaldehyde, and therefore, an intermediate product preferable for the methylation described later (such as methylolated melamine) can be easily produced. At least a part of the methanol is distilled off, so that the amount of free formaldehyde can be preferably 1.6 moles or less, and more preferably 1 mole or less per mole of melamine when the methylolation is completed. The methylolation can be performed at a temperature near the flux temperature while distilling off the methanol, or the methanol can be distilled off after completing the methylolation. Alternatively, after performing the methylolation while distilling off a part of the methanol, at least a part of the methanol remaining after the methylolation can be further distilled off for concentration.

(Methylation)

To the methylolated melamine (the intermediate product) obtained by the above-described methylolation, methanol and an acid catalyst are added to cause a reaction between the methylolated melamine and the methanol under an acidic condition. In the methylation, the methanol is allowed to be present in an amount of preferably 5 moles or more and 30 moles or less, and more preferably 10 moles or more and 25 moles or less per mole of the melamine. If the methanol remains in the intermediate product after the methylolation, the remaining amount of the methanol is included in calculating the amount of the methanol. If the amount (in mole) of the methanol is smaller than five times as much as the amount (in mole) of the melamine, the number of methylene groups in the resulting melamine formaldehyde initial condensate tends to be large.

The methylation is performed preferably under an acidic condition. More specifically, the methylation is performed at pH preferably ranging from 1 to 6.5 inclusive, and more preferably ranging from 2 to 5 inclusive. The acid catalyst used for adjusting the pH may be an inorganic acid (such as hydrochloric acid, sulfuric acid, phosphoric acid, or nitric acid), or an organic acid (such as formic acid, acetic acid, oxalic acid, or p-toluenesulfonic acid). One of these acid catalysts may be singly used, or two or more of these may be used in combination.

The methylation is performed preferably at a temperature of 25° C. or higher and the reflux temperature or lower (for example, 25° C. or more and 50° C. or less) for 0.5 hour or more and 5 hours or less. Besides, after completing the methylation in a solution, the solution is preferably neutralized to attain pH 8 or higher. For neutralizing the solution, a hydroxide of an alkali metal or an alkali earth metal (such as sodium hydroxide, potassium hydroxide, or calcium hydroxide), or a metal oxide (such as calcium oxide or magnesium oxide) can be used. The pH may be adjusted by using two or more compounds together. The resultant neutralized salt can be removed from the reaction system at an arbitrary stage. The neutralized salt may be removed immediately after the neutralization, or may be removed after concentrating the reaction product.

The miscibility of the shell material (such as a solution of a melamine formaldehyde initial condensate) with the solvent can be adjusted by changing the condition for the methylation. By changing the reaction conditions (such as the temperature, the time, the type of acid catalyst and pH), condensation can be performed simultaneously with the methylation. If a strong acid is used as the acid catalyst, a crosslinking reaction can more easily proceed than in the case where a weak acid is used, and the miscibility of the shell material (such as the solution of the melamine formaldehyde initial condensate) with the solvent tends to be lowered.

(Polymerization of Shell Material)

After obtaining the solution of the shell material as described above, the core 11 having been prepared by the aforementioned method is added to the solution of the shell material. Then, the core 11 is dispersed in the solution of the shell material. If the core 11 is homogeneously dispersed in the solution of the shell material, the shell layer 12 can be easily formed uniformly. Besides, the formation of the shell layer 12 is performed preferably in an aqueous medium. If the shell layer 12 is formed in an aqueous medium, dissolution of the binder resin 11*a* and elution of the internal additive 11*b* (the release agent in particular) are difficult to occur.

Examples of a method for satisfactorily disperse the core 11 in the solution of the shell material include a method in which the core 11 is mechanically dispersed in the solution of the shell material by using an apparatus capable of powerfully stirring a dispersion (hereinafter referred to as the first dispersion method), and a method in which the core 11 is dispersed in the solution of the shell material containing a dispersant (hereinafter referred to as the second dispersion method). Since the first dispersion method does not need a dispersant, the total organic carbon (TOC) concentration of a wastewater can be lowered. A suitable example of the stirring apparatus used in the first dispersion method includes "HIVIS MIX" manufactured by Primix Corporation. In the second dispersion method, the shell layer 12 can be easily formed uniformly. If the amount of the dispersant to be used is too large, however, the shell layer 12 may be formed with the dispersant attached to the surface of the core 11, and hence, there is a possibility that the bond between the core 11 and the shell layer 12 is weakened. In order to inhibit the shell layer 12 from peeling off from the core 11, or in order to lower the TOC concentration of the wastewater, the amount of the dispersant to be used is preferably 75 parts by mass or less based on 100 parts by mass of the core 11. Incidentally, the method for dispersing the core 11 is not limited to those described above, but the dispersion can be arbitrarily performed.

Suitable examples of the dispersant include sodium polyacrylate, poly(paravinylphenol), partially saponificated polyvinyl acetate, isoprene sulfonic acid, polyether, an isobutylene/maleic anhydride copolymer, sodium polyaspartate, starch, gelatin, acacia gum, polyvinyl pyrrolidone, and sodium lignosulfonate. One of these dispersants may be singly used, or two or more of these may be used in combination.

Subsequently, the temperature of the solution of the shell material to which the core 11 has been added is adjusted to a prescribed temperature (hereinafter designated as the shell forming temperature), and is kept at the shell forming temperature for a prescribed period of time. By keeping the temperature of the solution of the shell material at the shell forming temperature, the formation of the shell layer 12 (such as a curing reaction of the resin) proceeds in the solution of the shell material. As a result, an aqueous dispersion containing toner mother particles is obtained. Each toner mother particle contains the anionic core 11, and the cationic shell layer 12 coating the surface of the core 11. In the formation of the shell layer 12, if the core 11 shrinks due to surface tension, the softened core 11 may be spheroidized in some cases.

In order to cause the formation of the shell layer 12 to satisfactorily proceed, the shell forming temperature is preferably 40° C. or more and 95° C. or less, and more preferably 50° C. or more and 80° C. or less. Besides, in the case where the binder resin 11*a* is a resin having a hydroxyl group or a carboxyl group (such as a polyester resin) and the shell material contains a monomer or a prepolymer of an amino aldehyde resin, if the shell forming temperature is 40° C. or more and 95° C. or less, the hydroxyl group or carboxyl group exposed on the surface of the core 11 is reacted with a methylol group of the resin constituting the shell layer 12, so as to easily form a covalent bond between the binder resin 11*a* constituting the core 11 and the resin constituting the shell layer 12. Accordingly, the shell layer 12 can be strongly attached to the surface of the core 11.

Subsequently, the pH of the aqueous dispersion containing the toner mother particles thus obtained is adjusted to, for example, 7. Then, the aqueous dispersion containing the toner mother particles is cooled to ordinary temperature.

The method for forming the shell layer 12 described above can be arbitrarily changed in accordance with the structure, a desired characteristic or the like of the shell layer 12. For example, the core 11 may be added to the solvent before dissolving the shell material in the solvent. Besides, an unnecessary process may be omitted.

[Washing of Toner Mother Particles]

The toner mother particles may be washed with water if necessary. For example, the dispersion containing the toner mother particles is subjected to the solid-liquid separation (such as the filtration) to collect the toner mother particles in the form of a wet cake, and the thus obtained toner mother particles in the form of a wet cake are washed with water. The washing process is, however, not limited to this but the toner mother particles may be arbitrarily washed. For example, the toner mother particles contained in the dispersion are precipitated, the supernatant is exchanged with water, and the toner mother particles are dispersed again in water after the exchange.

[Drying of Toner Mother Particles]

The toner mother particles may be dried if necessary. For example, the toner mother particles can be dried by using a spray dryer, a fluidized-bed dryer, a vacuum freeze dryer, or a vacuum dryer. If a spray dryer is used for drying the toner mother particles, aggregation of the toner mother particles during the drying process can be suppressed. The drying process is, however, not limited to this but the toner mother particles may be arbitrarily dried.

[External Addition]

Onto the surface of each toner mother particle obtained as described above, the external additive 13 may be attached if necessary. As a suitable method for attaching the external additive 13, for example, the toner mother particles and the external additive 13 are mixed by using a mixer such as an FM mixer or a Nauta mixer under conditions where the external additive 13 is not buried in a surface portion of each toner mother particle. The method for the external addition is not, however, limited to this, but the external addition for the toner mother particles can be arbitrarily performed. For example, if a spray dryer is used in the drying process, a dispersion containing the external additive 13 (such as silica) may be sprayed together with the dispersion containing the toner mother particles. It is presumed that the production efficiency of the toner can be improved by thus simultaneously performing the drying process and the external addition process.

According to the method for producing a toner of the present embodiment described so far, a toner excellent in high-temperature preservability can be obtained. The toner obtained by the method for producing a toner of the present embodiment can be suitably used in an image forming apparatus in which, for example, an electrophotographic method, an electrostatic recording method, or an electrostatic printing method is applied.

Incidentally, the aforementioned production method for a toner can be arbitrarily modified in accordance with the structure, a desired characteristic or the like of the toner (the toner particle 10). An unnecessary process may be omitted. For example, if the external additive 13 is not used, the external addition process can be omitted. If no external additive is attached to the surface of the toner mother particle (namely, if the external addition process is omitted), the toner mother particle corresponds to the toner particle.

Examples

Examples of the present disclosure will now be described.

[Method for Producing Toner]

Samples 1 to 36 (more specifically, toners shown in a table of FIG. 4 described later) were produced by a method described below. The method for producing any of the samples includes a core preparing process, a shell layer forming process, a washing process, a drying process and an external addition process.

(Core Preparation)

A core was prepared by the pulverization/classification method. First, a binder resin (a polyester resin) and internal additives (a colorant, a release agent, and a charge control agent) were mixed. Specifically, 100 parts by mass of the polyester resin, 5 parts by mass of the colorant, 5 parts by mass of the charge control agent, and 5 parts by mass of the release agent were mixed by using a mixer (an FM mixer).

As the binder resin, a polyester resin having a hydroxyl value (OHV value) of 20 mgKOH/g, an acid value (AV value) of 40 mgKOH/g, a softening point (Tm) of 100° C., and a glass transition point (Tg) of 48° C. was used. As the colorant, C.I. Pigment Blue 15:3 (a phthalocyanine pigment) was used. As the charge control agent, a charge control agent ("BONTRON (registered trademark) P-51" manufactured by Orient Chemical Industries, Co., Ltd., a quaternary ammonium salt) was used. As the release agent, an ester wax ("WEP-3" manufactured by NOF Corporation) was used.

Subsequently, the thus obtained mixture was kneaded by using a two screw extruder ("PCM-30" manufactured by Ikegai Corporation). The resulting kneaded product was pulverized by using a mechanical pulverizer ("Turbo Mill" manufactured by Freund Turbo Corporation). The resulting pulverized product was classified by a classifier ("Elbow Jet" manufactured by Nittetsu Mining Co., Ltd.). In this manner, an anionic core having a volume average particle size ($D_{50}$) of 6.5 μm and a zeta potential at pH 4 of −15 mV was obtained.

This core had a glass transition point (Tg) of 40° C. The softening point (Tm) of the core was 90° C. Methods for measuring the Tg and Tm of the core will now be described.

<Method for Measuring Tg of Core>

A heat absorption curve of the core was measured by using a differential scanning calorimeter ("DSC-6200" manufactured by Seiko Instruments Inc.), so as to obtain the Tg of the core on the basis of a point of change in specific heat on the heat absorption curve.

<Method for Measuring Tm of Core>

The core was set on an elevated flow tester ("CFT-500D" manufactured by Shimadzu Corporation), and an S shaped curve was obtained by causing 1 $cm^3$ of the core to be melt flown under conditions of a die diameter of 1 mm, a plunger load of 20 $kg/cm^2$, and a temperature increasing rate of 6° C./min. Then, the Tm of the core was read from the thus obtained S shaped curve.

(Shell Layer Formation)

A solution of a melamine formaldehyde initial condensate synthesized by a method described below was used as a shell material.

<Method for Synthesizing Melamine Formaldehyde Initial Condensate>

A four-necked flask equipped with a thermometer, a reflux condenser and a stirring rod was set in a water bath, the flask was charged with 160.2 g (5.0 moles) of methanol, and the content of the flask was adjusted to pH 12 by using a sodium hydroxide aqueous solution. Subsequently, 169.7 g (5.2 moles) of paraformaldehyde (92% $CH_2O$) was added to the flask, and the flask was kept at 60° C. for 20 minutes by using the water bath to dissolve the paraformaldehyde in the methanol in the flask. Then, 126.1 g (1.0 mole) of melamine was added to the flask, and the content of the flask was adjusted to pH 12 by using a sodium hydroxide aqueous solution. Thereafter, while distilling off the methanol in the flask with the temperature within the flask set to a reflux temperature, the content of the flask was reacted (methylolated) for 1 hour.

Next, 640.8 g (20.0 moles) of methanol was added to an intermediate product obtained by the above-described methylolation (namely, methylolated melamine), the content of the flask was adjusted to pH 2 by using sulfuric acid, and the temperature within the flask was kept at a prescribed temperature for a prescribed period of time (more specifically, at a temperature for a time period shown in FIG. 3) to react (methylate) the content of the flask. Thereafter, the content of the flask was adjusted to pH 9 by using a sodium hydroxide aqueous solution, and the reaction (methylation) was thus halted by the neutralization. Subsequently, a neutralized salt produced by the neutralization was removed by filtration. The resultant filtrate was decompressed to 0.008 MPa by using a rotary evaporator and heated to 70° C. by using the water bath. As a result, a methanol solution of a melamine formaldehyde initial condensate (with an active ingredient concentration of 80% by mass) to be used as the shell material was obtained.

By the above-described method, methanol solutions of melamine formaldehyde initial condensates A to F shown in FIG. 3 were prepared. As illustrated in FIG. 3, the methanol solutions of the melamine formaldehyde initial condensates A, B, C, D, E, and F were obtained by the methylation performed respectively at a temperature of 30° C. for 3 hours, at a temperature of 35° C. for 3 hours, at a temperature of 40° C. for 3 hours, at a temperature of 45° C. for 3 hours, at a temperature of 50° C. for 3 hours, and at a temperature of 50° C. for 5 hours. The methanol solutions of the melamine formaldehyde initial condensates A, B, C, D, E, and F respectively had miscibility with a solvent (water) of 150, 250, 600, 800, 1000, and 1250% by mass, and respectively had viscosity of 4700, 1700, 1500, 1000, 800, and 500 mPa·s. The miscibility with the solvent (water) of each of the methanol solutions of the melamine formaldehyde initial condensates A to F (namely, the solubility of water in the methanol solution of each melamine formaldehyde initial condensate) was measured as follows. Each methanol solution of the melamine formaldehyde initial condensate was stirred at a measurement temperature of 60° C. while gradually adding water (ion-exchanged water) thereto, and dissolution limit of water (that is, a point of clouding) in the methanol solution of the melamine formaldehyde initial condensate was visually detected. Besides, the viscosity of each of the methanol solutions of the melamine formaldehyde initial condensates A to F was measured in accordance with JIS 1(7117-1 under conditions of 60 rpm and 25° C. by using a "BII type viscometer" manufactured by Told Sangyo Co., Ltd.

Next, a process for forming a shell layer by using each of the above-described methanol solutions of the melamine formaldehyde initial condensates will be described.

First, a 1 L three-necked flask equipped with a thermometer and a stirring blade was set in a water bath. Then, the temperature within the flask was kept at 30° C. by using the water bath. Subsequently, the flask was charged with 300 mL of ion-exchanged water, and dilute hydrochloric acid was further added thereto to adjust the aqueous medium (the ion-exchanged water) within the flask to pH 4.

Subsequently, a methanol solution of a melamine formaldehyde initial condensate (any one of the methanol solutions of the melamine formaldehyde initial condensates A to F shown in FIG. 3) used as the cationic shell material was added to the flask, and the content of the flask was stirred for dissolving the melamine formaldehyde initial condensate in the aqueous medium. The amount of the methanol solution of the melamine formaldehyde initial condensate to be added was varied depending on the thickness of a shell layer of a sample (a toner) to be produced. More specifically, if the shall layer is to be formed into 6 nm, 9 nm or 12 nm, the amount of the methanol solution of the melamine formaldehyde initial condensate (with an active ingredient concentration of 80% by mass) to be added was 2 mL, 3 mL, or 4 mL, respectively.

Subsequently, to the flask (to the solution in which the shell layer had been dissolved), 300 g of the core prepared by the aforementioned process was added, and the content of the flask was stirred at a speed of 200 rpm for 1 hour. Thereafter, 300 mL of ion-exchanged water was added to the flaks, the temperature within the flask was increased to 70° C. at a rate of 1° C./min while stirring the content of the flask at 100 rpm, and the content of the flask was then stirred under conditions of (a shell forming temperature of) 70° C. and 100 rpm for 2 hours. Thus, a shell layer was formed on the surface of the core.

After keeping the temperature of 70° C. for 2 hours, sodium hydroxide was added to the flask to adjust the content of the flask to pH 7. Subsequently, the content of the flask was cooled to ordinary temperature, and thus, a dispersion containing toner mother particles was obtained.

(Washing of Toner Mother Particles)

After forming the toner mother particles (including the core and the shell layer), the toner mother particles were washed. The dispersion was subjected to the solid-liquid separation (filtration) by using a Buchner funnel to obtain the toner mother particles in the form of a wet cake. Then, the toner mother particles in the form of a wet cake were dispersed again in ion-exchanged water to wash the toner mother particles. Such washing with ion-exchanged water (including filtration and dispersion) was repeated five times. The conductivity of the filtrate resulting from the washing (i.e., the washing water) was 4 μS/cm regardless of the amount of the added methanol solution of the melamine formaldehyde initial condensate. The conductivity was measured by using an electrical conductivity meter "HORIBA ES-51" manufactured by Horiba Ltd. The TOC concentration of the filtrate resulting from the washing (the washing water) was 8 mg/L or less. Thereafter, the TOC concentration of the filtrate (the washing water) could be lowered to 3 mg/L or less (corresponding to the level of tap water) by general reverse osmosis (RO). For measuring the TOC concentration, "TOC-4200" manufactured by Shimadzu Corporation was used.

(Drying of Toner Mother Particles)

After washing the toner mother particles as described above, the toner mother particles were dried. The toner mother particles collected from the dispersion were dried by allowing them to stand in an atmosphere of 40° C. for 48 hours.

(External Addition)

After drying the toner mother particles as described above, the toner mother particles were subjected to the external addition. As an external additive, hydrophobic silica fine particles having a BET specific surface area of 130 $m^2/g$ ("REA-200" manufactured by Nippon Aerosil Co., Ltd.) were used. More specifically, 100 parts by mass of the toner mother particles and 0.5 part by mass of the external additive were mixed to attach the external additive to the surfaces of the toner mother particles. Thus, electrostatic latent image developing toners each containing a large number of toner particles (the samples 1 to 36) were produced.

The samples 1 to 36 (of the toners) were produced by similar methods except that at least one of the shell material (any of the methanol solutions of the melamine formaldehyde initial condensates A to F as shown in FIGS. 3 and 4), the zeta potential of the core in the dispersion adjusted to pH 4 (any of −15.0 mV, −10.1 mV, −5.2 mV, and −3.5 mV as shown in FIG. 4), and the thickness of the shell layer (any of 6 nm, 9 nm, and 12 nm as shown in FIG. 4) was changed. In all the samples 1 to 36, a core having a volume average particle size ($D_{50}$) of 6.5 μm, roundness (a shape index) of 0.93, Tm of 90° C., Tg of 40° C., and a frictional charge amount obtained by using a standard carrier of −20 μC/g was obtained. The miscibility of the shell material (the solution of the melamine formaldehyde initial condensate) with the solvent (water) fell in a range of 250% by mass or more and 1000% by mass or less in the samples 1 to 27, 30, 33, and 36, but did not fall in the range of 250% by mass or more and 1000% by mass or less in the other samples. Besides, the zeta potential of the core in the dispersion adjusted to pH 4 was higher than −5 mV (specifically, −3.5 mV) in the samples 30, 33, and 36, but was equal to or lower than −5 mV in the other samples. The zeta potential of the core was adjusted by changing the amount of the charge control agent (BONTRON P-51) added to the core. More specifically, as the amount of the added charge control agent (BONTRON P-51) was larger, the zeta potential of the core was higher. When the amount of the charge control agent (BONTRON P-51) to be added was changed to be 0 part by mass, 5 parts by mass, 10 parts by mass, 15 parts by mass, or 20 parts by mass based on 100 parts by mass of the binder resin (the polyester resin), the zeta potential of the core at pH 4 was changed respectively to be −20 mV, −15 mV, −10.1 mV, −5.2 mV and −3.5 mV. Incidentally, the methods for measuring the particle size, the roundness, the frictional charge amount, the zeta potential, and the thickness of the shell layer will be described later.

[Evaluation Method]

The samples 1 to 36 were evaluated as follows. It is noted that the core (the core of the toner particle contained in each sample) was evaluated before capsulation (formation of the shell layer).

(Particle Size)

The volume average particle size ($D_{50}$) of the core or the toner particle of each sample was measured by using "Coulter Counter Multisizer 3" manufactured by Beckman Coulter.

(Shape Index)

The shape index (roundness) of the core or the toner particle of each sample was measured by using a flow type particle image analyzer ("FPIA-3000" manufactured by Sysmex Corporation). More specifically, the roundness of 3000 cores or toner particles of each sample was measured, and an average of the measured roundness of the 3000 cores or toner particles was obtained as an evaluation value.

(Frictional Charge Amount)

A hundred (100) parts by mass of a standard carrier N-01 (a standard carrier for a negatively chargeable toner available from The Imaging Society of Japan), and 7 parts by mass of particles (core or toner particles) of each sample were mixed for 30 minutes by using a Turbula mixer. The thus obtained mixture was used as a measurement sample for measuring a frictional charge amount. More specifically, the frictional charge amount of the measurement sample was measured by using a QM meter ("MODEL 210HS-2A" manufactured by TREK Inc.).

(Zeta Potential)

A magnet stirrer was used for mixing 0.2 g of particles (core or toner particles) of each sample, 80 g of ion-exchanged water, and 20 g of a 1% by mass nonionic surfactant ("Polyvinyl pyrrolidone K-85" manufactured by Nippon Shokubai Co., Ltd.) to obtain a dispersion by homogeneously dispersing the particles (core or toner particles) of the sample in the aqueous medium. Subsequently, dilute sulfuric acid was added to the resultant dispersion to adjust the dispersion to pH 4. After thus adjusting the pH, the dispersion was used as a measurement sample for measuring a zeta potential. More specifically, the zeta potential of the particles (core or toner particles of the sample) contained in the measurement sample (i.e., the dispersion adjusted to pH 4) was measured by using a zeta potential-particle size analyzer ("Delsa Nano HC" manufactured by Beckman Coulter).

(Shell Layer Thickness)

Each sample (toner) was dispersed in a cold-setting epoxy resin, and the resultant was allowed to stand still in an atmosphere of 40° C. for 2 days. Thus, a cured substance of the toner was obtained. Subsequently, the cured substance was dyed with osmium tetroxide. Thereafter, a thin sample with a thickness of 200 nm was cut out from the dyed cured substance by using an ultramicrotome ("EM UC6" manufactured by Leica Microsystems). The cross-section of the thus obtained thin sample was observed by using a transmission electron microscope (TEM) ("JSM-6700 F" manufactured by JEOL Ltd.). Besides, a TEM photograph of the cross-section of the thin sample (i.e., the cross-section of the toner particle) was taken.

The thickness of the shell layer was measured by analyzing the TEM photograph of the cross-section of the toner particle thus taken by using image analysis software ("WinROOF" manufactured by Mitani Corporation). Specifically, two straight lines were drawn to cross at substantially the center of the cross-section of the toner particle, and the lengths of four sections of the two straight lines crossing the shell layer were measured. An average of the thus measured lengths of the four sections was defined as an evaluation value of one toner particle (as the thickness of the shell layer of one toner particle measured). This measurement of the thickness of the shell layer was performed on ten toner particles contained in each sample (toner). Thus, an average of the thicknesses of the shell layers of the ten toner particles measured (the evaluation values of the respective toner particles) was determined as an evaluation value of the toner (the thickness of the shell layer of the measured toner).

If the shell layer is too thin, it may be difficult to measure the thickness of the shell layer because the interface between the core and the shell layer is unclear on a TEM image. In such a case, the interface between the core and the shell layer is made clear by combining a TEM image with electron energy loss spectroscopy (EELS) for measuring the thickness of the shell layer. Specifically, mapping of an element characteristic of the material of the shell layer (a nitrogen element) was performed on the TEM image by the EELS.

(High-Temperature Preservability)

Two (2) g of each sample (toner) was weighed in a 20 mL plastic vessel, and the resultant was allowed to stand still for 3 hours in a thermostat heated at 60° C. Thus, a toner for high-temperature preservability evaluation was obtained. Then, the toner for high-temperature preservability evaluation was sifted by using a 100 mesh sieve (having an opening of 150 μm) set on a powder tester manufactured by Hosokawa Micron K.K. under conditions of a rheostat scale of 5 and time of 30 seconds in accordance with an instruction manual of the powder tester. After sifting, the mass of the toner remaining on the sieve was measured. On the basis of the mass of the toner before sifting and the mass of the toner remaining on the sieve after sifting, a degree of aggregation (% by mass) was obtained as the high-temperature preservability in accordance with the following formula 2.

Degree of aggregation (% by mass)=(Mass of toner remaining on sieve/mass of toner before sifting)×100 Formula 2:

(Lowest Fixing Temperature)

A hundred (100) parts by mass of a developer carrier (a carrier for FS-05250DN) and 10 parts by mass of each sample (toner) were mixed for 30 minutes by using a ball mill Thus, a two-component developer was prepared.

As an evaluation apparatus, a printer modified so that a fixing temperature could be adjusted by a Roller-Roller type heat pressure fixing unit (with a nip width of 8 mm) (specifically, a modified machine of "FS-05250DN" manufactured by Kyocera Document Solutions Inc.) was used. The two-component developer prepared as described above was supplied to a cyan developing unit of the evaluation apparatus, and the sample (toner) was supplied to a cyan toner container of the evaluation apparatus.

The linear speed of the evaluation apparatus was set to 200 mm/sec and the toner placement amount was set to 1.0 mg/cm$^2$, and a recording medium (printing paper of 90 g/m$^2$) was conveyed to pass through the fixing unit. The nip passing time was 40 msec. Besides, the measurement range for the fixing temperature was 100 to 200° C. More specifically, with the fixing temperature of the fixing unit increased from 100° C. in increments of 5° C., a solid image was fixed on the recording medium. Thus, a lowest temperature (a lowest fixing temperature) at which the solid image could be fixed on the recording medium without offset was measured.

[Evaluation Results]

Figure 5:
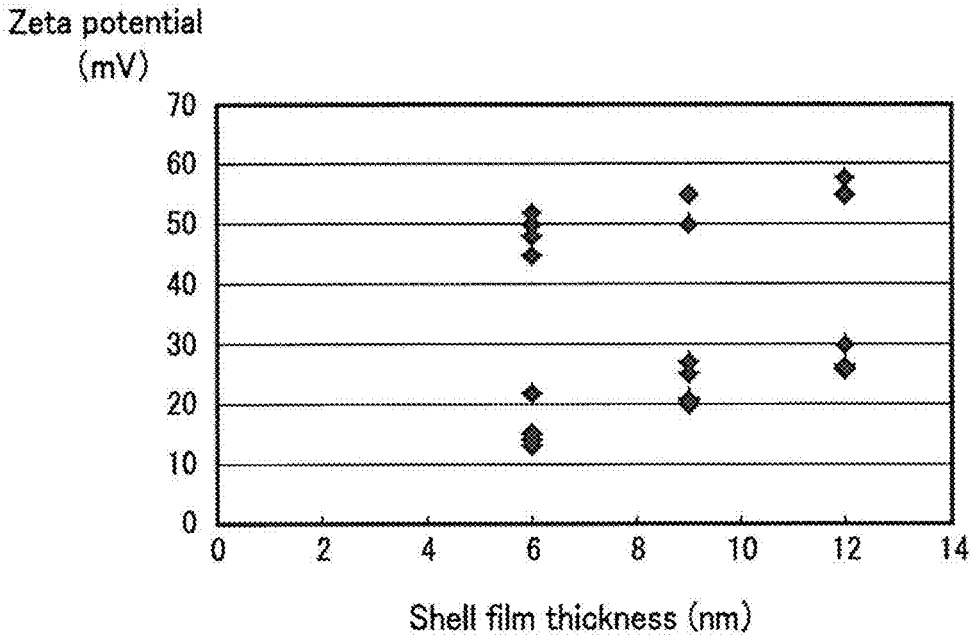
FIG. 5 is a graph illustrating a relationship between a shell film thickness and a zeta potential in respective samples obtained in the methods for producing toners according to the examples of the present disclosure.

The evaluation results of the samples 1 to 36 (of the toners) obtained by the aforementioned production method are shown in FIGS. 4 and 5. FIG. 5 is a graph illustrating the relationship between the shell film thickness (thickness of the shell layer) and the zeta potential of the toner particle obtained as data of the samples 1 to 27 (corresponding to the toners of examples of the present disclosure) shown in FIG. 4. Now, the evaluation results of the samples 1 to 36 will be described with reference to FIGS. 4 and 5.

In the samples 1 to 27 (of the toners of the present examples), excellent high-temperature preservability (a low degree of aggregation) was obtained. As compared with the degrees of aggregation of the samples 28 to 36, the degrees of aggregation of the samples 1 to 27 were extremely low. This is probably for the following reason: In the production method for each of the samples 1 to 27, the core having a zeta potential measured in the dispersion adjusted to pH 4 of −5 mV or less and the shell material (i.e., the solution of the melamine formaldehyde initial condensate) having miscibility with the solvent (water) of 250% by mass or more and 1000% by mass or less were used. Therefore, in the formation of the shell layer, the shell material (i.e., the melamine formaldehyde initial condensate) can be strongly bonded to the surface of the core while retaining high dispersibility of the core.

Incidentally, in the samples 30, 33, and 36, although the miscibility of the shell material falls in the range of 250% by mass or more and 1000% by mass or less, the degree of aggregation of the toner was high. Since the zeta potential at pH 4 of the core was higher than −5 mV in the samples 30, 33, and 36, the anionic property of the core is probably not sufficient for sufficiently adsorbing the cationic shell material onto the surface of the core. This is probably because the polymerization of the core and the shell material did not sufficiently proceed.

The production method for each of the samples 1 to 27 (of the toners) included the steps of preparing a core having a zeta potential at pH 4 of −5 mV or less, and forming a shell layer on the surface of the core in a solution of a cationic shell material dissolved in a solvent. In addition, the miscibility of the shell material with the solvent (water) was 250% by mass or more and 1000% by mass or less. It is presumed that the shell material can be strongly bonded to the surface of the core while keeping high dispersibility of the core in the formation of the shell layer in the production method for a toner including these steps. Besides, it is presumed that the dispersibility of the core can be retained high even without using a dispersant in the formation of the shell layer. Furthermore, it is presumed that if the shell material is strongly bonded to the surface of the core, the resultant toner can attain excellent high-temperature preservability.

The present disclosure is not limited to the above-described examples. For example, the method for preparing a core is not limited to the pulverization/classification method. Also when a core is prepared by the aggregation method, a toner having excellent high-temperature preservability can be obtained as long as the production method for the toner includes the above-described steps.

What is claimed is:

1. A method for producing a toner, comprising the steps of:

preparing a core having a zeta potential at pH 4 of −5 mV or less; and forming a cationic shell layer on a surface of the core in a solution in which a material of the shell layer having miscibility with a solvent of 250% by mass or more and 1000% by mass or less is dissolved in the solvent.

2. A method for producing a toner according to claim 1, wherein the material of the shell layer contains a monomer or a prepolymer of a thermosetting resin.

3. A method for producing a toner according to claim 1, wherein the material of the shell layer contains a monomer or a prepolymer having an amino group.

4. A method for producing a toner according to claim 1, wherein the material of the shell layer contains a monomer or a prepolymer of an amino aldehyde resin.

5. A method for producing a toner according to claim 4, wherein the material of the shell layer contains a melamine formaldehyde initial condensate.

6. A method for producing a toner according to claim 4, wherein the core contains a binder resin having a hydroxyl group or a carboxyl group.

7. A method for producing a toner according to claim 6, wherein a temperature of the solution in forming the shell layer is 40° C. or more and 95° C. or less.

8. A method for producing a toner according to claim 1, wherein a content of a nitrogen atom in the material of the shell layer is 10% by mass or more.

* * * * *